US009470177B2

(12) United States Patent
Jones et al.

(10) Patent No.: US 9,470,177 B2
(45) Date of Patent: Oct. 18, 2016

(54) CYLINDER HEAD FOR INTERNAL COMBUSTION ENGINE

(71) Applicant: Cummins Inc., Columbus, IN (US)

(72) Inventors: Jeffrey D. Jones, Columbus, IN (US); Vipin Prabhakaran, Prune (IN); David M. Barnes, Columbus, IN (US)

(73) Assignee: Cummins Intellectual Property, Inc., Minneapolis, MN (US)

( * ) Notice: Subject to any disclaimer, the term of this patent is extended or adjusted under 35 U.S.C. 154(b) by 94 days.

(21) Appl. No.: 14/597,671

(22) Filed: Jan. 15, 2015

(65) Prior Publication Data

US 2015/0167581 A1 Jun. 18, 2015

Related U.S. Application Data

(63) Continuation of application No. 13/531,932, filed on Jun. 25, 2012, now Pat. No. 8,950,374.

(51) Int. Cl.

| | |
|---|---|
| ***F02F 1/42*** | (2006.01) |
| ***F02F 1/24*** | (2006.01) |
| *F02F 1/00* | (2006.01) |

(52) U.S. Cl.

CPC ..... *F02F 1/24* (2013.01); *F02F 1/242* (2013.01); *F02F 1/4285* (2013.01); *F02F 1/42* (2013.01); *F02F 2001/008* (2013.01)

(58) Field of Classification Search

CPC ..... F02F 1/24; F02F 1/4214; F02F 1/242; F02F 2001/008; F02F 1/42; F02F 2001/248; F02F 2007/0041; F02F 2007/0063

USPC ..... 123/193.3, 193.1, 193.5, 293.2, 657, 123/659, 198 F, 188.7, 195 R, 195 AC, 123/195 HC

See application file for complete search history.

(56) References Cited

U.S. PATENT DOCUMENTS

| | | | | |
|---|---|---|---|---|
| 4,455,973 | A | 6/1984 | Stadler et al. | |
| 4,530,323 | A * | 7/1985 | Wakasa | F02F 1/40 123/193.5 |
| 5,094,193 | A | 3/1992 | Yoshikawa | |
| 5,326,034 | A | 7/1994 | Peters | |
| 5,775,272 | A | 7/1998 | Matsunaga et al. | |
| 5,819,704 | A | 10/1998 | Tarr et al. | |
| 5,868,107 | A | 2/1999 | Betsch et al. | |
| 6,142,116 | A * | 11/2000 | Freese, V | F02B 75/22 123/188.14 |

(Continued)

FOREIGN PATENT DOCUMENTS

| | | |
|---|---|---|
| DE | 102004062522 | 7/2006 |
| EP | 1028247 | 8/2000 |

(Continued)

OTHER PUBLICATIONS

International Search Report and Written Opinion of the International Searching Authority in related patent application PCT/US2013/047672, Oct. 15, 2013, 12 pages.

*Primary Examiner* — Lindsay Low
*Assistant Examiner* — Long T Tran
(74) *Attorney, Agent, or Firm* — Faegre Baker Daniels LLP

(57) ABSTRACT

Rib configurations for increasing the structural efficiency of a cylinder head, which relates to a peak combustion pressure capability of the cylinder head. In addition to increasing peak combustion pressure, the rib configurations may also improve sealing of the cylinder head and may improve the durability of an associated cylinder head gasket.

19 Claims, 8 Drawing Sheets

(56) References Cited

U.S. PATENT DOCUMENTS

| | | | | |
|---|---|---|---|---|
| 6,276,338 | B1 | 8/2001 | Kato et al. | |
| 7,059,291 | B2 * | 6/2006 | Ueno | F02F 7/006 123/193.5 |
| 7,128,028 | B2 | 10/2006 | Paul et al. | |
| 2005/0172917 | A1 | 8/2005 | Betsch et al. | |
| 2009/0062795 | A1 * | 3/2009 | Vakharia | A61B 18/14 606/52 |
| 2009/0114173 | A1 | 5/2009 | Haubner et al. | |

FOREIGN PATENT DOCUMENTS

| | | |
|---|---|---|
| JP | H10169504 | 6/1998 |
| JP | 2000230456 | 8/2000 |
| JP | 2006097579 | 4/2006 |
| JP | 2011174437 | 9/2011 |
| KR | 100828795 | 5/2008 |
| WO | WO03100237 | 12/2003 |

* cited by examiner

CYLINDER HEAD FOR INTERNAL COMBUSTION ENGINE

This application is a continuation of U.S. patent application Ser. No. 13/531,932, filed on Jun. 25, 2012, now U.S. Pat. No. 8,950,374, issued on Feb. 10, 2015, the disclosure of said application being expressly incorporated herein in its entirety by reference thereto.

TECHNICAL FIELD

This disclosure relates to cylinder heads for internal combustion engines. More specifically, this disclosure relates to a cylinder head configuration that has a greater structural efficiency than conventional cylinder heads. The structural efficiency of a cylinder head relates to a cylinder pressure capability for a given mass of the cylinder head.

BACKGROUND

The fuel efficiency of vehicles has been increasing in response to government regulations and customer expectations. One way to increase fuel efficiency of a vehicle is to decrease the weight of the vehicle. For vehicles propelled by an internal combustion engine, the weight of the internal combustion engine can represent a significant portion of the weight of the vehicle. Thus, an opportunity to reduce the weight of an internal combustion engine represents an opportunity to improve fuel efficiency of an associated vehicle. Because of the size and complexity of internal combustion engines, there may remain unexpected and unanticipated opportunities to reduce the weight of such engines.

In addition to reducing weight, if a cylinder head of an internal combustion engine could be configured to increase a combustion pressure capability while reducing weight, increased combustion pressure could be realized. Increasing combustion pressure causes more thorough or improved combustion of fuel, which will reduce emissions and increase engine efficiency.

SUMMARY

This disclosure provides a cylinder head for an internal combustion engine. The cylinder head comprises a bottom deck, a component bore, a bolt boss, a valve boss, and a first rib. The component bore has a wall extending longitudinally from the bottom deck. The bolt boss extends longitudinally from the bottom deck and is in a position at a first radial distance from the component bore. The valve boss is in a position at a second radial distance from the component bore. The second radial distance is less than the first radial distance. The first rib extends longitudinally upward from the bottom deck, connecting to the bolt boss at a first end, and extends to a location on an upper portion of the bolt boss.

This disclosure also provides a cylinder head for an internal combustion engine. The cylinder head comprises a bottom deck, a component bore, a bolt boss, a valve boss, an intake passage, an exhaust passage, and a first rib. The component bore has a component bore wall extending longitudinally from the bottom deck. The bolt boss extends longitudinally from the bottom deck and is in a position at a first radial distance from the component bore. The valve boss is in a position at a second radial distance from the component bore. The second radial distance is less than the first radial distance. The intake passage is formed in the cylinder head and the intake passage includes an intake passage wall. The exhaust passage is formed in the cylinder head and the exhaust passage includes an exhaust passage wall. The first rib extends longitudinally upward from one of the intake passage wall and the exhaust passage wall to connect to a location on the component bore wall.

This disclosure also provides a cylinder head for an internal combustion engine. The cylinder head comprises a bottom deck, at least one intake passage, at least one exhaust passage, a component bore, a plurality of bolt bosses, a plurality of valve bosses, and a plurality of ribs. The intake exhaust passage wall. The component bore includes a component bore wall and a component bore center extending longitudinally from the bottom deck. Each bolt boss of the plurality of bolt bosses extends longitudinally from the bottom deck and includes a bolt boss center. Each of the plurality of bolt bosses is positioned at spaced angles about the component bore at one or more first radial distances from the component bore. Each valve boss of the plurality of valve bosses has a valve boss center and extends longitudinally from one intake passage or one exhaust passage wall. Each one of the plurality of valve bosses is positioned at spaced angles about the component bore at one or more second radial distances, the second radial distances being less than the first radial distances. The plurality of ribs extends longitudinally from at least one of the group consisting of the bottom deck, the intake passage wall, and the exhaust passage wall and the plurality of ribs connects to at least one of the group consisting of the plurality of bolt bosses, the plurality of valve bosses, and the component bore wall.

Advantages and features of the embodiments of this disclosure will become more apparent from the following detailed description of exemplary embodiments when viewed in conjunction with the accompanying drawings.

DETAILED DESCRIPTION

Figure 1:
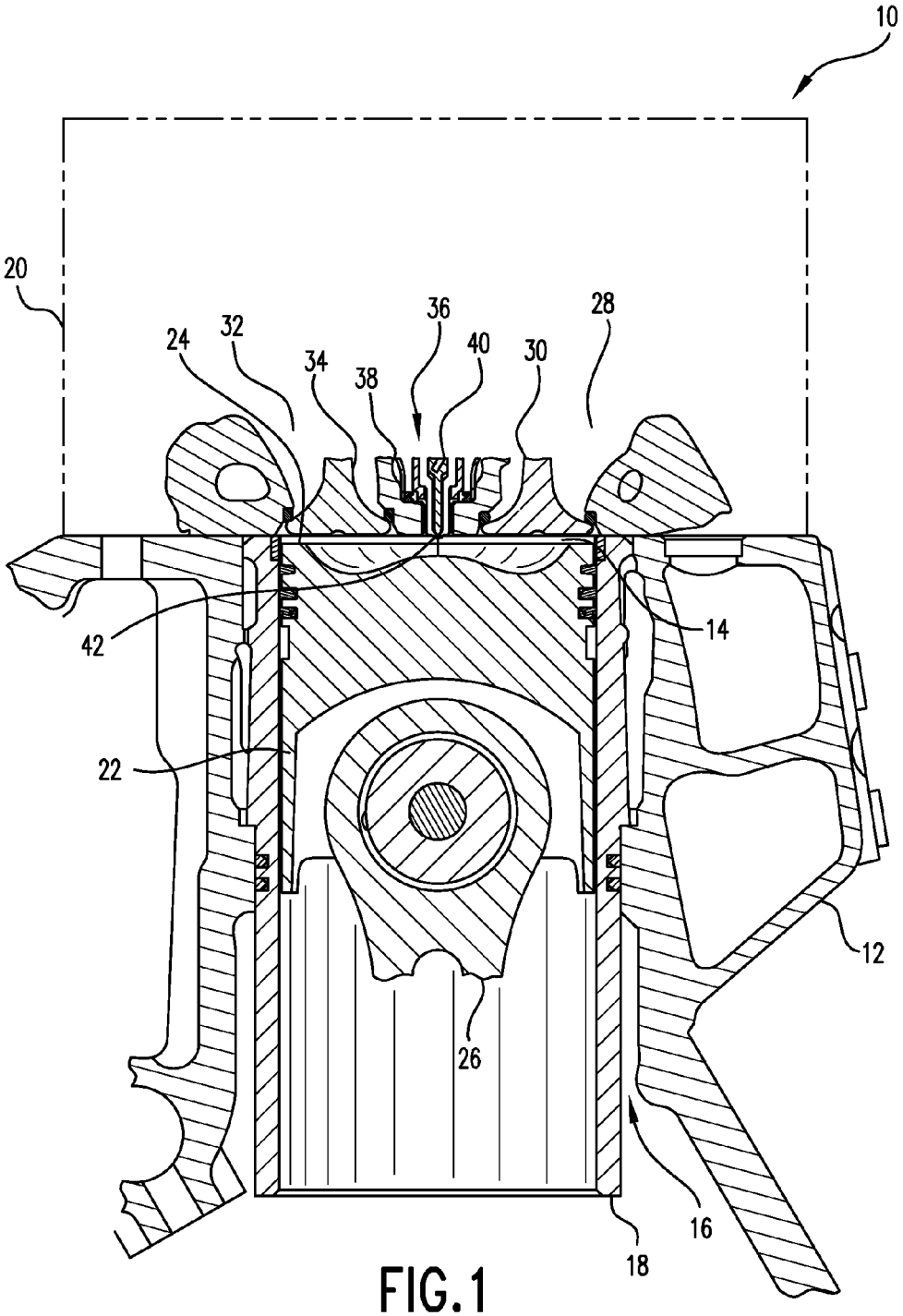
FIG. 1 PRIOR ART
FIG. 1 is a sectional view of a portion of a conventional internal combustion engine.
Figure 2:
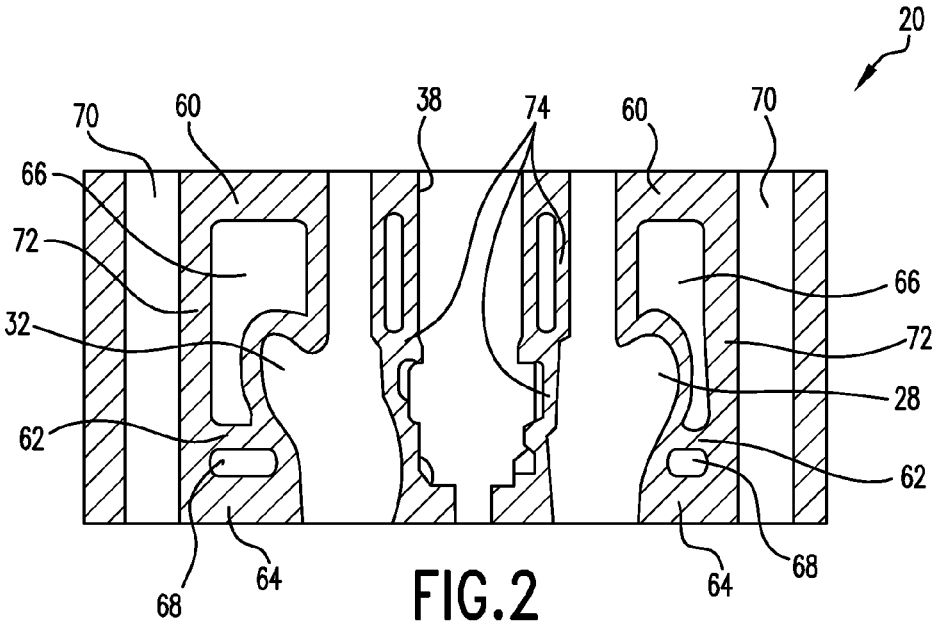
FIG.2 PRIOR ART
FIG. 2 is a sectional view of a conventional cylinder head of the internal combustion engine of FIG. 1.

Referring to FIGS. 1 and 2, a portion of a conventional internal combustion engine is shown in a cross sectional view and generally indicated at 10. Engine 10 includes an engine body or block 12, a small portion of which is shown, and at least one combustion chamber 14. Of course, engine 10 may contain a plurality of combustion chambers, for example four, six or eight, which may be arranged in a line or in a "V" configuration. Each combustion chamber 14 is formed at one end of a cylinder cavity 16, which may be formed directly in engine body 12. Cylinder cavity 16 may be adapted to receive a removable cylinder liner 18. Engine 10 also includes a cylinder head 20 that attaches to engine body 12 to close cylinder cavity 16. As will be seen from the following description, an improved cylinder head configuration is described that increases a peak combustion pressure (PCP) capability of an engine's cylinder head.

Engine 10 further includes a piston 22 positioned for reciprocal movement within each cylinder liner 18 in association with each combustion chamber 14. Piston 22 may be any type of piston so long as it contains the features identified hereinbelow necessary for accomplishing the present disclosure. For example, piston 22 may be an articulated piston or a single piece piston.

An upper surface or top face 24 of piston 22 cooperates with cylinder head 20 and the portion of cylinder liner 18 extending between cylinder head 20 and piston 22 to define combustion chamber 14. Although not specifically illustrated, piston 22 connects to a crankshaft of engine 10 by way of a connecting rod 26 that causes piston 22 to reciprocate along a rectilinear path within cylinder liner 18 as the engine crankshaft rotates. FIG. 1 illustrates piston 22 at a top dead center (TDC) position achieved when the crankshaft is positioned to move piston 22 to the furthest most position away from the rotational axis of the crankshaft. In a conventional manner, piston 22 moves from the TDC position to a bottom dead center (BDC) position when advancing through the intake and power strokes. For purposes of this disclosure, the words "outward" and "outwardly" correspond to the direction away from the engine crankshaft and the words "inward" and "inwardly" correspond to the direction toward the engine crankshaft or the BDC position of piston 22.

Engine 10 of the present disclosure may be a four-cycle compression ignition (diesel) engine employing direct injection of fuel into each combustion chamber 14. An intake passage 28 formed in cylinder head 20 selectively directs intake air into combustion chamber 14 by means of a pair of intake poppet valves 30 positioned in cylinder head 20, only one of which is illustrated in FIG. 1. Similarly, an exhaust passage 32 formed in cylinder head 20 selectively poppet valves 34 positioned in cylinder head 20, only one of which is illustrated in FIG. 1. The opening and closing of valves 30 and 34 may be achieved by a mechanical cam or hydraulic actuation system (not shown) or other motive system in a carefully controlled time sequence with the reciprocal movement of piston 22.

At the uppermost, TDC position shown in FIG. 1, piston 22 has just completed its upward compression stroke during which charge air allowed to enter combustion chamber 14 from intake passages 28 is compressed, thereby raising its temperature above the ignition temperature of the engine's fuel. This position is usually considered the zero position commencing the 720 degrees of rotation required to complete four strokes of piston 22. The amount of charge air that is caused to enter combustion chamber 14 and the other combustion chambers of engine 10 may be increased by providing a pressure boost in engine 10's intake manifold (not shown). This pressure boost may be provided, for example, by a turbocharger (not shown), including a compressor driven by a turbine powered by engine 10's exhaust or driven by engine 10's crankshaft (not shown).

Engine 10 also includes a fuel injector 36, securely mounted in a central, component, or fuel injector bore 38 formed in cylinder head 20, for injecting fuel at very high pressure into combustion chamber 14 when piston 22 is approaching, at, or moving away from, the TDC position. In other configurations, central bore 38 may include a spark plug or other ignition device in place of fuel injector 36, which would then be positioned elsewhere in cylinder head 20. Injector 36 includes, at its inner end, an injector nozzle assembly 40. Injector 36 includes a plurality of injection orifices 42, formed in the lower end of nozzle assembly 40, for permitting high-pressure fuel to flow from a nozzle valve cavity of injector 36 into combustion chamber 14 at a very high pressure to induce thorough mixing of the fuel with the high temperature, that injector 36 might be any type of injector capable of injecting high-pressure fuel through a plurality of injector orifices into combustion chamber 14 in the manner described hereinbelow. For example, injector 36 may be a closed nozzle injector or an open nozzle injector. Moreover, injector 36 may include a mechanically actuated plunger housed within the injector body for creating the high pressure during an advancement stroke of the plunger assembly. Alternatively, injector 36 may receive high-pressure fuel from an upstream high-pressure source such as a pump-line-nozzle system including one or more high-pressure pumps and/or a high-pressure accumulator and/or a fuel distributor. Injector 36 may include an electronically actuated injection control valve that supplies high-pressure fuel to the nozzle valve assembly to open injector nozzle assembly 40, or controls the draining of high-pressure fuel from the nozzle valve cavity to create a pressure imbalance on a nozzle valve element of injector nozzle assembly 40. The pressure imbalance thereby causes the nozzle valve element to open and close to form an injection event. For example, the nozzle valve element may be a conventional spring-biased closed nozzle valve element actuated by fuel pressure, such as disclosed in U.S. Pat. No. 5,326,034, the entire content of which is incorporated by reference. Injector 36 may be in the form of the injector disclosed in U.S. Pat. No. 5,819,704, the entire content of which is hereby incorporated by reference.

Referring to FIG. 2, conventional cylinder head 20 includes a top deck 60, a mid deck 62, and a bottom deck 64. Top deck 60, mid deck 62 and bottom deck 64 work with other features of cylinder head 20 to form an upper coolant gallery 66 and a lower coolant gallery 68. Upper coolant gallery 66 and lower coolant gallery 68 contain a flowing cooling fluid to remove heat generated in combustion chamber 14. A plurality of bores 70 formed in cylinder head 20 accept bolts (not shown) to attach cylinder head 20 to engine body 12. A sidewall portion 72 connects bottom deck portion 64 to mid deck portion 62 lower coolant gallery 68. Injector or central bore 38 may have an injector, component, or central bore wall portion 74.

Figure 3:
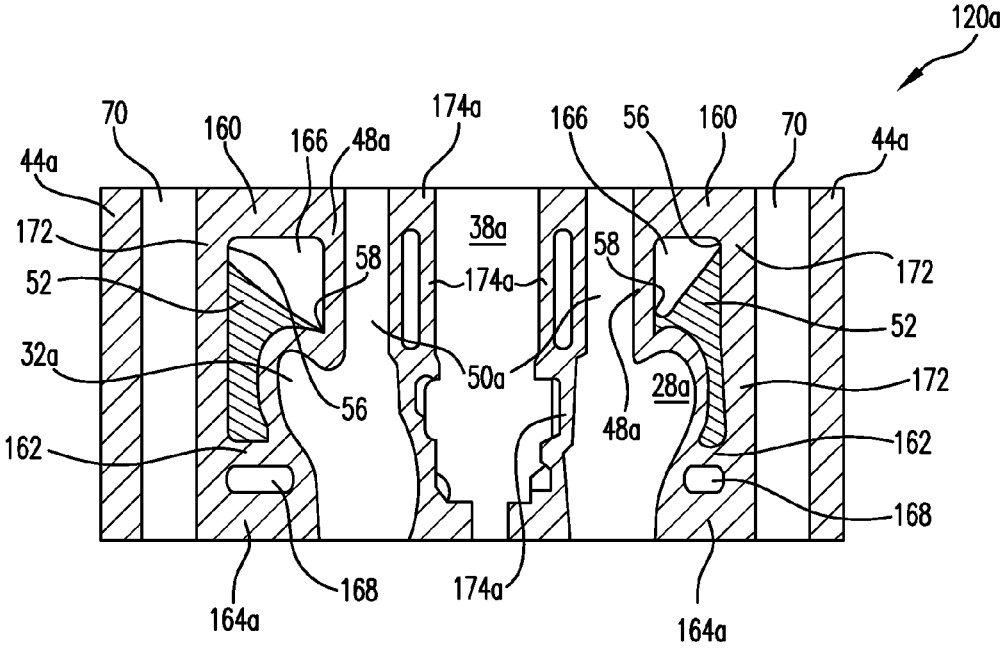
FIG. 3 is a sectional view of a cylinder head in accordance with a first exemplary embodiment of the present disclosure along the lines 3-3 in FIG. 5.
Figure 4:
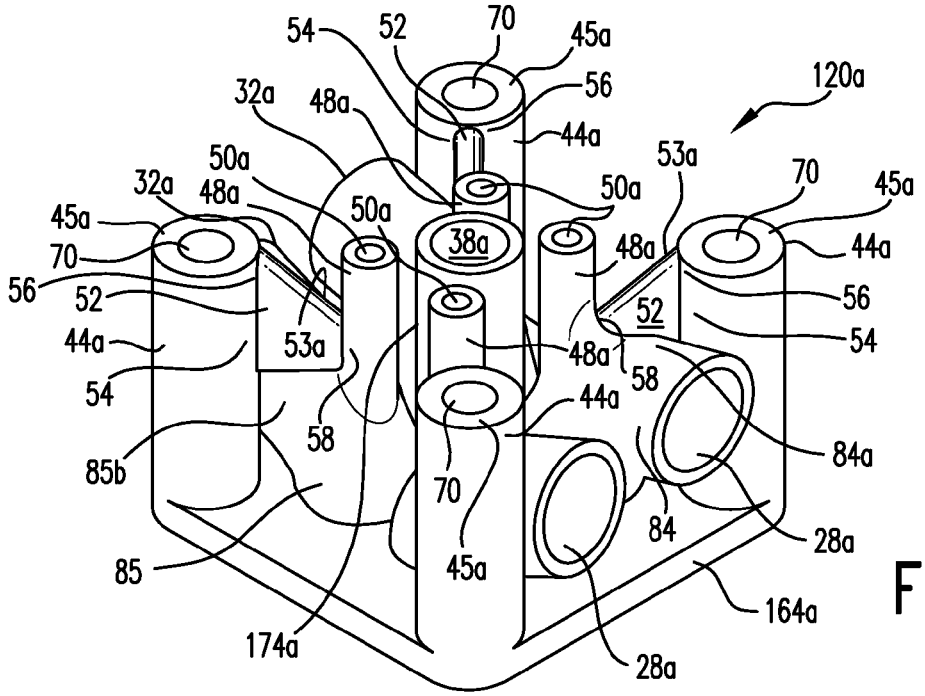
FIG. 4 is a perspective view of the cylinder head of FIG. 3 with certain portions removed.
Figure 5:
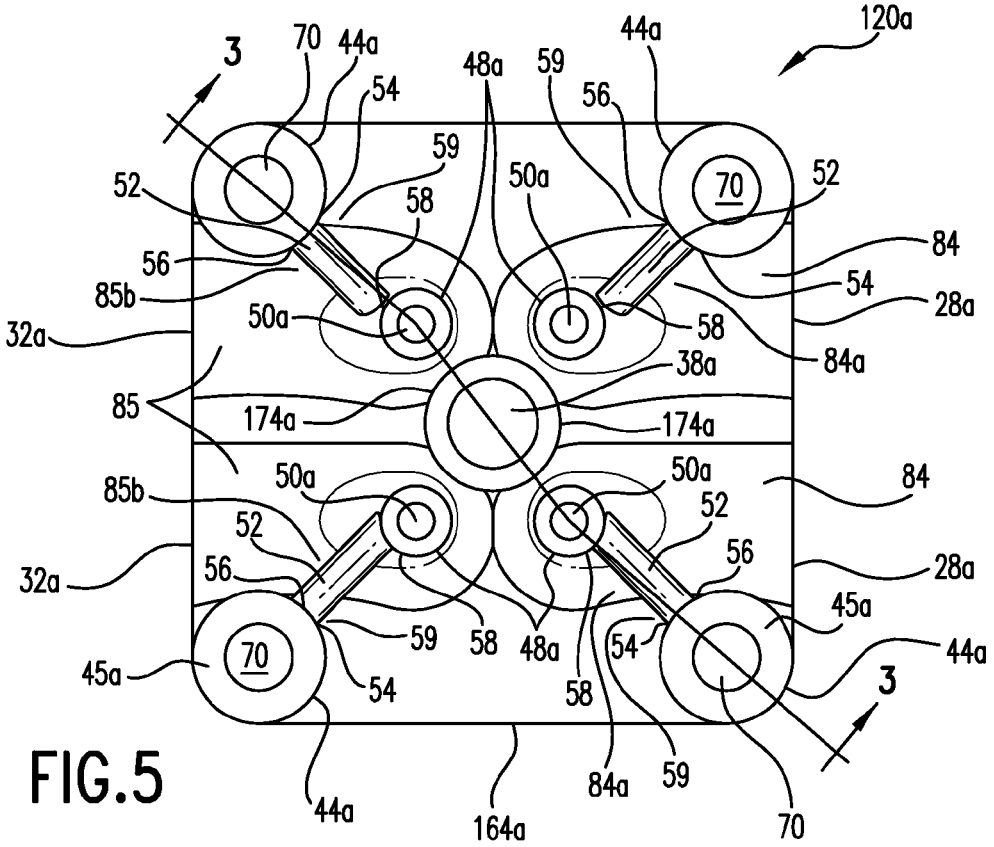
FIG. 5 is a plan view of the cylinder head of FIG. 4.

Referring now to FIGS. 3-5, a cylinder head **120*a* in accordance with a first exemplary embodiment of the present disclosure is shown. As can be seen in FIG. 3, cylinder head 120*a* includes a fire, bottom or lower deck 164*a*, a mid or middle deck 162, and a top or upper deck 160. A sidewall portion 172 connects bottom deck 164***a* to mid-deck 162 and upper deck 160. As will be explained in more detail hereinbelow, upper deck 160, mid-deck 162, and sidewall portion 172 are not directly related to the improvements of the present disclosure and are removed for clarity in FIGS. 4-15 that describe exemplary embodiments of the present disclosure. Fire deck 164*a*, mid deck 162, top deck 160, sidewall portion 172, and a central bore wall 174*a* cooperate to form an upper coolant gallery 166 and a lower coolant gallery 168.

As best seen in FIGS. 4 and 5, cylinder head 120*a* further includes a plurality of longitudinally extending bolt bosses 44*a* that extend from bottom deck 164*a* of cylinder head 120*a*. Bolt bosses 44*a* are arranged at spaced angles about a central bore 38*a*, and may be symmetrically arranged about central bore 38*a*. Central bore 38*a* may include a fuel injector, a spark plug, or other ignition device. Each bolt boss 44*a* may be at approximately the same first radial distance from central bore 38*a* or each bolt boss 44*a* may be at a different radial distance from central bore 38*a*. Thus, central bore 38*a* is positioned in a middle or central area with respect to bolt bosses 44*a*, but such position may be un-centered or offset with respect to the center of the pattern defined by bolt bosses 44*a*. Each bolt boss 44*a* includes bore 70 that receives a mounting bolt (not shown) to attach cylinder head 120*a* to engine body 12. Cylinder head 120*a* also includes a plurality of valve bosses 48*a* angularly arrayed about central bore 38*a*. As with bolt bosses 44*a*, valve bosses 48*a* may be arranged symmetrically about central bore 38*a*. Each valve boss 48*a* includes a valve bore 50*a*. Each valve reciprocal movement within each valve bore 50*a*. Each valve boss 48*a* is located at a second radial distance from central bore 38*a* that is less than any of the radial distances to each bolt boss 44*a*. Each valve boss 48*a* may be at approximately the same radial distance from central bore 38*a*, or each valve boss may be at a different second radial distance from central bore 38*a*. Thus, central bore 38*a* is located in the area bounded by the pattern formed by valve bosses 48*a*, but central bore 38*a* may be un-centered or offset with respect to the center of the pattern formed by valve bosses 48*a*. A section extending longitudinally through bottom deck 164*a* that includes the central axis of central bore 38*a* and extends radially outward from central bore 38*a* to intersect the central axis of one valve boss 48*a* then extends radially outward through one bolt boss 44*a*. The section may include a single plane or may include a plurality of planes, as shown by lines 3-3 in FIG. 5. As can be seen, for example, in FIG. 3, which is shown along one such section, each valve boss 48*a* is positioned radially between one central bore 38*a* and one bolt boss 44*a*. Thus, each bolt boss 44*a* is radially further from central bore 38*a* than each respective valve boss 48*a*.

Extending from bottom deck 164*a* is a plurality of intake passages 28*a* and a plurality of exhaust passages 32*a*. Each intake passage 28*a* opens in bottom deck 164*a* and extends away from bottom deck 164*a*, curving to extend between a first pair of bolt bosses 44*a*. Thus, each intake passage 28*a* forms an angle for the intake airflow, an angle that may be approximately 90 degrees. Intake passages 28*a* connect to an engine intake manifold (not shown). Exhaust passages 32*a* also open in bottom deck 164*a*, initially extending away from bottom deck 164*a* in a direction that may be parallel to intake passages 28*a*. Exhaust passages 32*a* may then curve to extend between another or second pair of bolt bosses 44*a* in a direction that is generally opposite from where intake passages 28*a* extend between the first pair of bolt bosses 44*a*. Each exhaust passage 32*a* forms an angle for the exhaust flow, an angle that may be manifold (not shown).

A wall or rib 52 extends longitudinally upward or away from an upper wall portion 84*a* of a wall portion 84 of each intake passage 28*a*. Wall or rib 52 connects to and extends upwardly along an interior boss portion 54 of bolt boss 44*a* to a boss portion or location 56 that is near a top surface 45*a* of bolt boss 44*a*. In an exemplary embodiment, rib 52 extends to a location on bolt boss 44*a* that is at least 50% of the distance from bottom deck 164*a* to top surface 45*a*. Preferably, rib 52 extends to a location on bolt boss 44*a* that is at least 75% of the distance from bottom deck 164*a* to top surface 45*a*. The connection of rib 52 to bolt boss 44*a* is at a first side or end of rib 52. Wall or rib 52 also extends to and connects to an interior boss portion 58 of a valve boss 48*a* at the base of each valve boss 48*a*. The connection of rib 52 to valve boss 48*a* is at a second end or side of rib 52. One valve boss 48*a* also extends from each wall portion 84 of each intake passage 28*a*. Rib 52 may extend upwardly along valve boss 48*a*, but to permit adequate cooling fluid flow through cylinder head 120*a*, rib 52 preferably extends to less than 50% of the distance from the base of valve boss 48*a* to the top of valve boss 48*a*. Each rib 52 may also extend longitudinally from a bottom deck portion 59 of bottom deck 164*a* in some locations, as may be best seen in FIG. 5. The extension of ribs 52 from bottom deck 164*a* is possible because wall portions 84 and, as described hereinbelow, a plurality of wall portions 85 of exhaust passages 32*a*, extend from bottom deck 164*a*. However, wall portions 84 and wall portions 85 may not extend from bottom deck 164*a* in all locations where ribs 52 may be positioned between each bolt boss 44*a* and each valve boss 48*a*, thus leaving locations for ribs 52 to extend from bottom deck 164*a*.

One wall or rib 52 also extends longitudinally upward from an upper wall portion 85*a* of wall portion 85 of each exhaust passage 32*a*. Each wall or rib 52 connects to and extends upwardly along interior boss portion 54 of one boss 44*a*. The connection of rib 52 to bolt boss 44*a* is at a first side or end of rib 52. In an exemplary embodiment, rib 52 extends to a location on bolt boss 44*a* that is at least 50% of the distance from bottom deck 164*a* to top surface 45*a*. Preferably, rib 52 extends to a location on bolt boss 44*a* that is at least 75% of the distance from bottom deck 164*a* to top surface 45*a*. Wall or rib 52 also extends to and connects to interior boss portion 58 of a valve boss 48*a* at the base of each valve boss 48*a*. The connection of rib 52 to valve boss 48*a* is at a second end or side of rib 52. One valve boss 48*a* also extends from each wall portion 85 of each exhaust passage 32*a*. Rib 52 may extend upwardly along valve boss 48*a*, but to permit adequate cooling fluid flow through cylinder head 120*a*, rib 52 should extend to less than 50% of the distance from the base of valve boss 48*a* to the top of valve boss 48*a*. Each rib 52 may also extend longitudinally away from bottom deck portion 59 of bottom deck 164*a* in some locations, as may be best seen in FIG. 5. The extension of ribs 52 from bottom deck 164*a* is possible because wall portions 85 also extend from bottom deck 164*a*, but may not extend from bottom deck 164*a* in all locations where ribs 52 may be positioned between each bolt boss 44*a* and each valve boss 48*a*, thus leaving locations for ribs 52 to extend from bottom deck 164*a*.

Each rib 52 terminates in an upper or top edge 53*a*. Upper or top edge 53*a* may appear to be generally flat or a straight line when viewed from a side of rib 52, or perpendicular to the longitudinal extent of rib 52 that extends from bottom deck 164*a*. However, upper or top edge 53*a* may also form a slight convex shape. It is less preferable for upper or top edge 53*a* to form a concave shape because such a shape is less capable of handling stresses transmitted from bottom deck 164*a*, walls 84 and walls 85 to bolt bosses 44*a*. Except when noted, the shape of the ribs in the subsequent embodiments should be similar to the shape of ribs 52.

A peak cylinder pressure capability (PCP) of a conventional cylinder head similar to cylinder head 20, which may be defined as the pressure exerted on a cylinder head by an associated combustion chamber, was measured to be 193 bar. The configuration of the first embodiment of the present disclosure achieves 240 bar peak cylinder pressure. The material of conventional cylinder head 20 and first embodiment cylinder head 120*a* that achieves the aforementioned PCP is gray iron. The dimensions that may be associated with cylinder head 120*a* are as follows: a bottom deck or fire deck 164*a* thickness of 17 millimeters; a mid deck 162 thickness of 5 millimeters; a top deck 160 thickness of 15 millimeters; a distance of the center of mid deck 162 longitudinally from the center of bottom deck 164*a* of 27.5 millimeters; a thickness of a side wall portion 172 of 13 millimeters; and a minimum thickness of a central bore wall 174*a* of 10 millimeters. The thickness of each rib 52 should be sufficient for casting purposes. For example, the thickness of ribs 52 may be in the range 3 millimeters to 10 millimeters, such as 5 millimeters thick. Ribs 52 may be thicker if needed, but should be configured to avoid interference with the function of upper coolant gallery 166. Ribs 52 should be limited to the minimum thickness necessary to withstand the design PCP, otherwise cylinder head 120*a* uses more material than necessary and becomes heavier than needed. All the aforementioned features that include a connection or joint should contain a radius at the connection. The joint radius should be as large as practicable. For example, a beneficial radius may be approximately 6 millimeters. Of course, depending on the space available, such connection or joint radii could be much larger.

The principal benefit of ribs 52 is that they permit removal of 75% of the material in the area of upper water jacket or coolant gallery 166 while retaining or even increasing the PCP of cylinder head 120*a*. This benefit is provided by limiting or reducing the material unrelated to the strength of cylinder head 120*a*, while adding material at the locations and in the increasing the PCP by appropriate placement of ribs 52 was an unexpected result. In the first exemplary embodiment of the present disclosure, the result of the addition of ribs 52 in conjunction with the dimensions provided above led to an increase in the structural efficiency of cylinder head 120*a* over a conventional cylinder head of 15%, where structural efficiency is defined as the ratio of stiffness to mass. As previously described, ribs 52 permit removal of material from cylinder head 120*a* while increasing the PCP of cylinder head 120*a*, thus leading to the improved structural efficiency. The structural stiffness of cylinder head 120*a*, which is defined as the capacity to resist deformation under applied load, was increased by 32% over a conventional cylinder head. Modifying the various dimensions provided hereinabove in combination with ribs 52 would lead to improvements in the PCP and the structural efficiency that are different from the example just provided.

Figure 6:
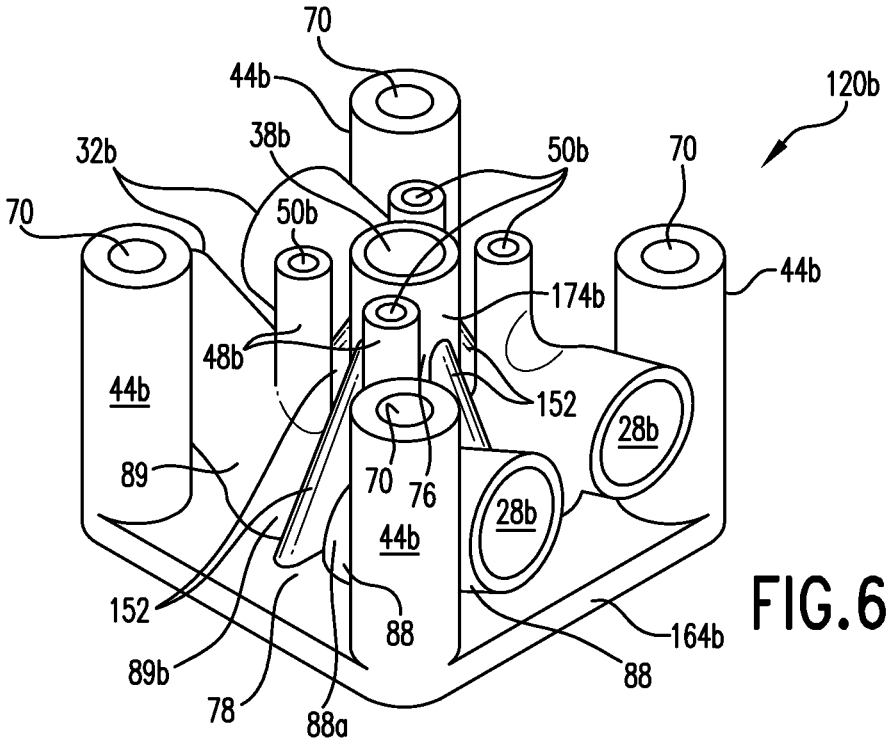
FIG. 6 is a perspective view of a cylinder head in accordance with a second exemplary embodiment of the present disclosure.
Figure 7:
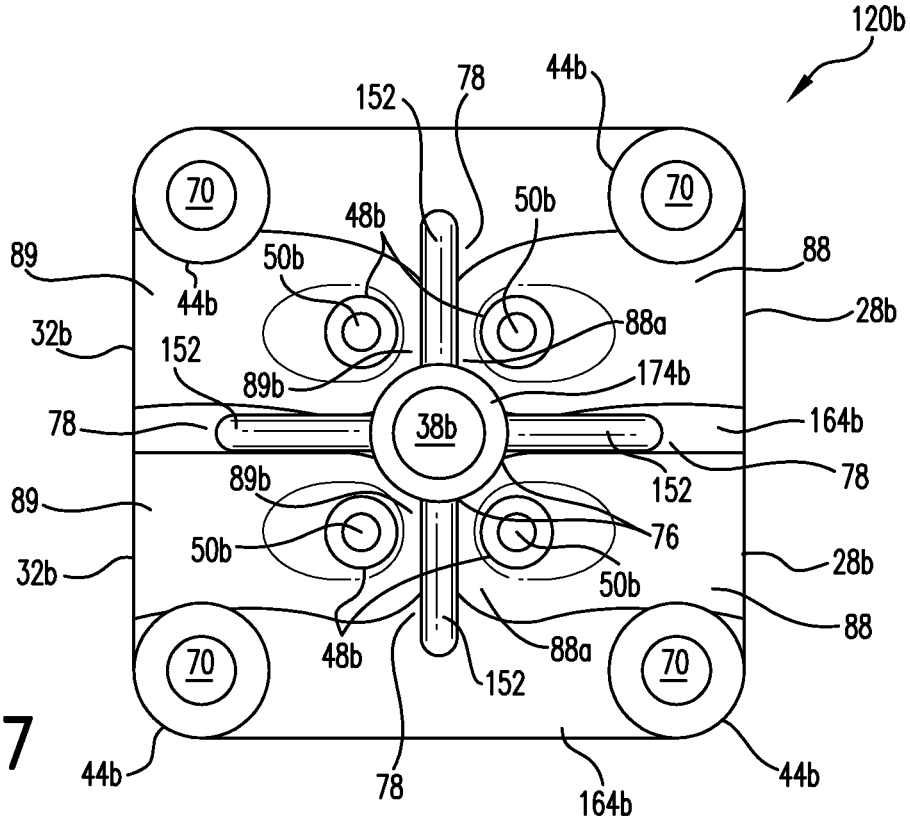
FIG. 7 is a plan view of the cylinder head of FIG. 6.

A second exemplary embodiment cylinder head of the present disclosure, indicated generally at 120*b*, is shown in FIGS. 6 and 7. Features having the same number as the previous embodiments or features having the same number as the previous embodiments and an appended letter, e.g., 44*a*, 44*b*, function similarly to the previous embodiments and are described in this embodiment only to the extent needed for clarity.

Cylinder head 120*b* features a plurality of ribs 152 that extend longitudinally from a fire or bottom deck 164*b* at a bottom deck portion 78 to connect to a central portion 76 of a central bore wall 174*b*, forming an angle to fire deck 164*b*. Portion 78 is located on bottom deck 164*b* between a wall portion 88 of an intake passage 28*b* and a wall portion 89 of an exhaust passage 32*b*. A portion of ribs 152 may connect or attach to an upper wall portion 88*a* of wall portion 88, or an upper wall portion 89*b* of wall portion 89, or both, depending on the location of an edge of wall 88 where wall 88 originates from bottom deck 164*b* and the location of an edge of wall 89 where wall 89 when used with ribs 52. Ribs 152 may be used by themselves, though with less PCP capability than ribs 52.

Figure 8:
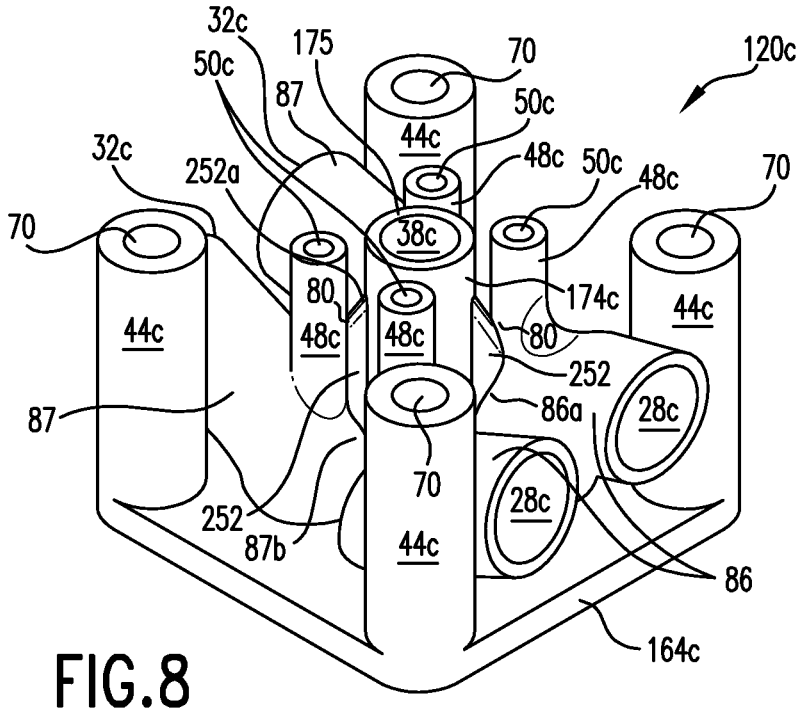
FIG. 8 is a perspective view of a cylinder head in accordance with a third exemplary embodiment of the present disclosure.
Figure 9:
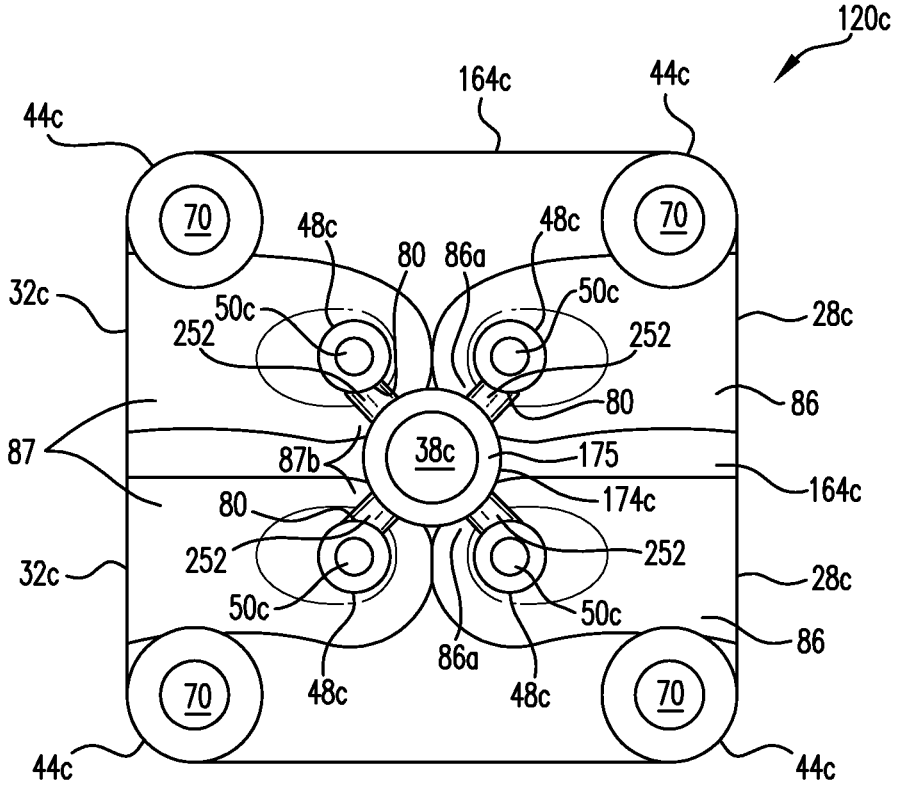
FIG. 9 is a plan view of the cylinder head of FIG. 8.

A third exemplary embodiment cylinder head of the present disclosure, indicated generally at 120*c*, is shown in FIGS. 8 and 9. Features having the same number as the previous embodiments or features having the same number as the previous embodiments and an appended letter, e.g., 44*a*, 44*b*, function similarly to the previous embodiments and are described in this embodiment only to the extent needed for clarity.

Cylinder head 120*c* features a plurality of ribs 252 that extend longitudinally from an upper wall portion 86*a* of a wall portion 86 of an intake passage 28*c* or an upper wall portion 87*b* of a wall portion 87 of an exhaust passage 32*c*. Ribs 252 connect to and extend longitudinally upward along a central bore wall 174*c* at a first end of ribs 252, and connect to and extend longitudinally upward along a boss portion 80 of a valve boss 48*c* at a second end of ribs 252. Boss portion 80 is positioned on a side of valve boss 48*c* that faces central bore wall 174*c*. Each rib 252 extends to a point on central bore wall 174*c* that is as longitudinally as far from a bottom deck 164*c* as possible while maintaining adequate cooling fluid flow through cylinder head 120*c*. In an exemplary embodiment, each rib 252 extends to a point along central bore wall 174*c* at least 50% of the distance from bottom deck 164*c* to a top surface 175 of central bore wall 174*c*. Each rib 252 also extends to a point on valve boss 48*c* that is as longitudinally as far from bottom deck 164*c* as possible while maintaining adequate cooling fluid flow through cylinder head 120*c*. In an exemplary embodiment, each rib 252 extends to a point along valve boss 48*c* that is longitudinally less than the distance rib 252 extends along central bore wall 174*c*.

An upper edge 252*a* of rib 252 forms an angle to fire deck 164*c*, with the connection of upper edge 252*a* to central bore wall 174*c* longitudinally portion 80 of valve boss 48*c*. Thus, upper edge 252*a* extends longitudinally downward toward bottom deck 164*c* as upper edge 252*a* extends from central bore wall 174*c* to valve boss 48*c*. Ribs 252 provide additional PCP capability for cylinder head 120*c* when used in conjunction with ribs 52. Ribs 252 may also be used in conjunction with ribs 152. While ribs 252 may be used by themselves, the improvement in PCP is much less than the improvement in PCP provided by ribs 52 or ribs 152, and thus ribs 252 are more effective when used with one or more other ribs described in the other embodiments of this disclosure.

Figure 10:
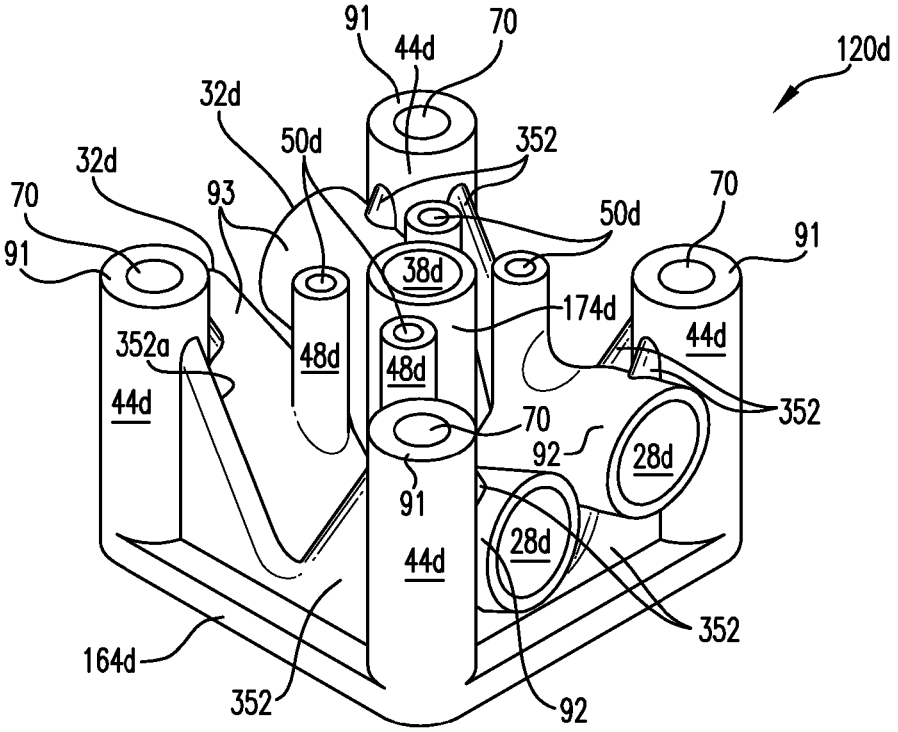
FIG. 10 is a perspective view of a cylinder head in accordance with a fourth exemplary embodiment of the present disclosure.
Figure 11:
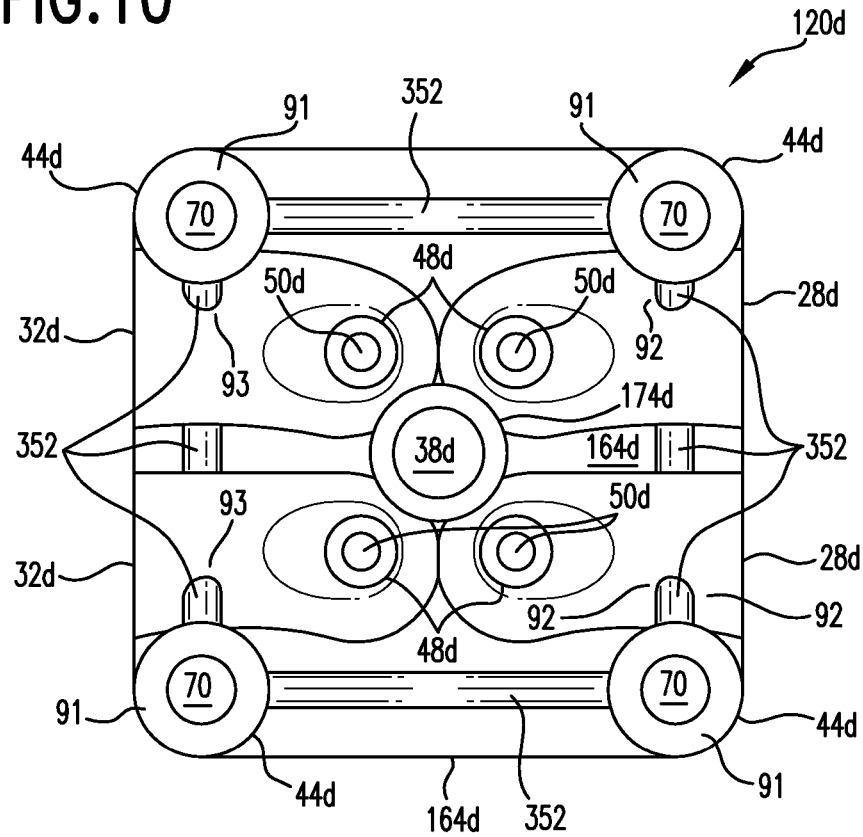
FIG. 11 is a plan view of the cylinder head of FIG. 10.

A fourth exemplary embodiment cylinder head of the present disclosure, indicated generally at 120*d*, is shown in FIGS. 10 and 11. Features having the same number as the previous embodiments or features having the same number as the previous embodiments and an appended letter, e.g., 44*a*, 44*b*, function similarly to the previous embodiments and are described in this embodiment only to the extent needed for clarity.

Cylinder head 120*d* features a plurality of ribs 352, each of which extends longitudinally upward from a bottom deck 164*d* and connects at a first end or side and a second end or side of ribs 352 to facing wall portions of a pair of bolt bosses 44*d*, connecting bolt bosses 44*d* to bottom deck 164*d*. A top edge 352*a* of each rib 352 connects to bolt boss 44*d* at a longitudinal location as far as possible from bottom deck 164*d* as possible while providing adequate cooling fluid flow through cylinder head 120*d*. Top edge 352*a* of each rib 352 extends at an angle from each bolt boss 44*d* at a location on each bolt boss 44*d* that may be more than 50% of the longitudinal distance from bottom deck 164*d* to a top surface 91 of each bolt boss 44*d* toward bottom deck 164*d*, forming a "V" shape when viewed in a direction that is perpendicular to rib 352.

One rib 352 extends longitudinally upward at least in part from one or more wall portions 92 of one or more intake passages 28*d*. Where this rib 352 of a respective intake passage 28*d*. A portion of rib 352 may extend into an intake passage 28*d* to provide additional structural capacity to rib 352. However, the amount that rib 352 extends into intake passages 28*d* cannot interfere with adequate intake airflow through intake passages 28*d*. One rib 352 extends longitudinally upward at least in part from one or more wall portions 93 of one or more exhaust passages 32*d*. Where this rib 352 connects to wall portions 93, rib 352 is blended or radiused into wall portion 93 of a respective exhaust passage 32*d* to provide additional structural capacity to rib 352. A portion of rib 352 may extend into an exhaust passage 32*d* to provide additional structural capacity to rib 352. However, the amount that rib 352 extends into exhaust passages 32*d* cannot interfere with adequate exhaust flow through exhaust passages 32*d*.

Ribs 352 provide improved sealing of cylinder head 120*d* with an engine body by increasing the rigidity of cylinder head 120*d*. The increased rigidity of cylinder head 120*d* improves the sealing effectiveness of a sealing mechanism located between cylinder head 120*d* and an associated engine body. Such sealing mechanism may include a head gasket located between cylinder head 120*d* and the associated engine body. Ribs 352 may also improve durability of an associated head gasket since flexing of the head gasket along the sealing joint is reduced by the presence of ribs 352. Ribs 352 may be used with one or more of the ribs of the previously described embodiments. By using ribs 352 in combination with one or more of the previously described embodiments, sealing of cylinder head 120*d* against an associated engine may be further improved.

Figure 12:
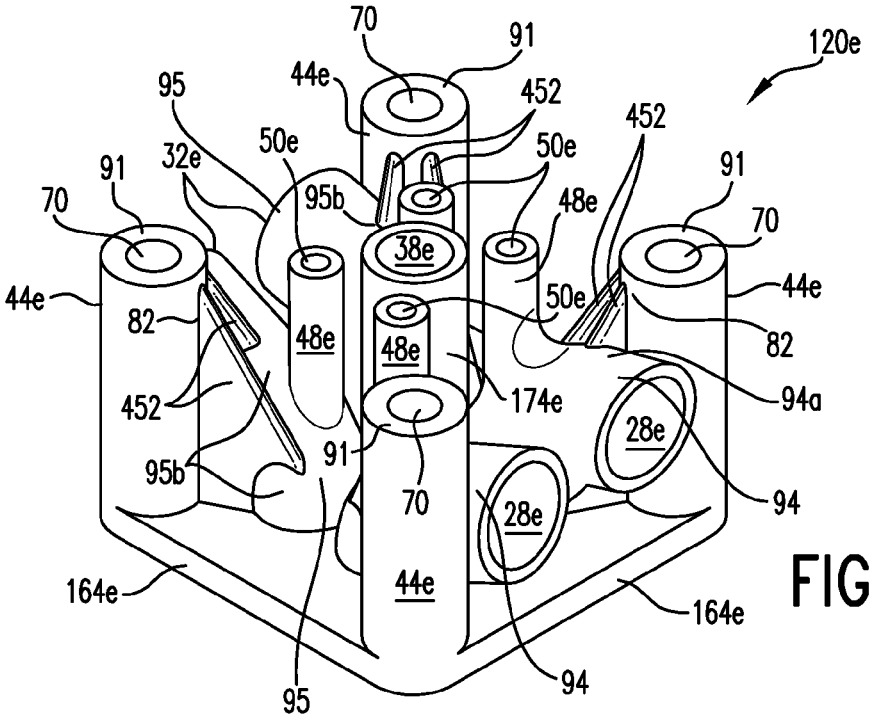
FIG. 12 is a perspective view of a cylinder head in accordance with a fifth exemplary embodiment of the present disclosure.
Figure 13:
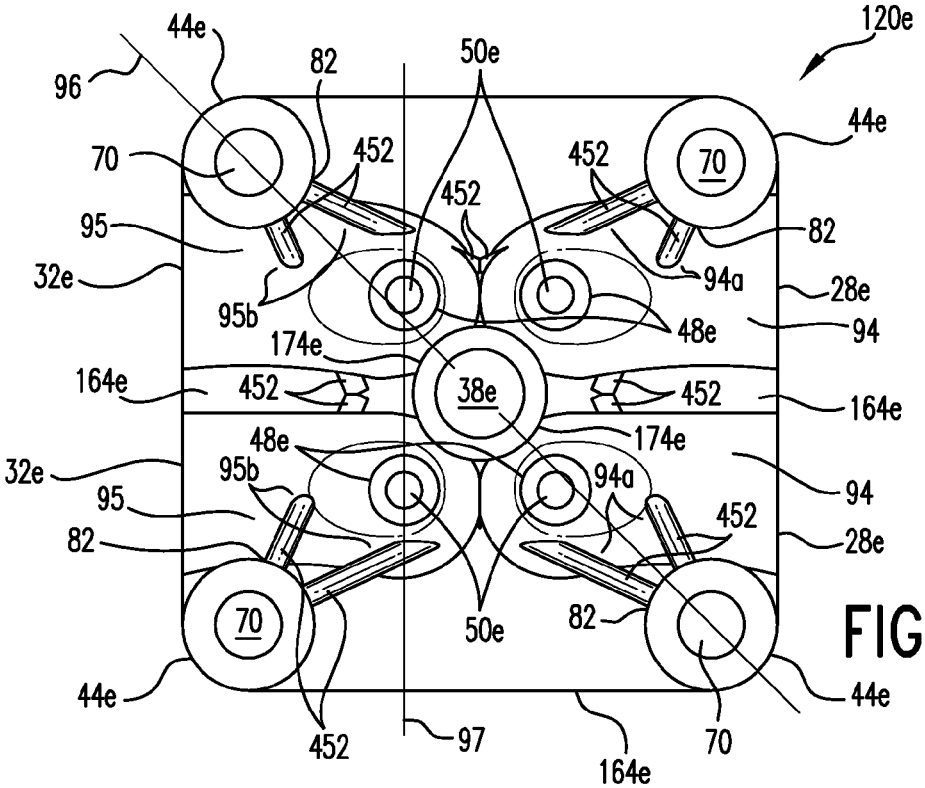
FIG. 13 is a plan view of the cylinder head of FIG. 12.

A fifth exemplary embodiment cylinder head of the present disclosure, indicated generally at 120*e*, is shown in FIGS. 12 and 13. Features having the same number as the previous embodiments or features having the same number as the previous embodiments and an appended letter, e.g., 44*a*, embodiment only to the extent needed for clarity.

Cylinder head 120*e* features ribs 452. A pair of ribs 452 extends longitudinally away or upwardly from a bottom deck 164*e*, from a wall portion 94 of an intake passage 28*e*, and/or from a wall portion 95 of an exhaust passage 32*e*, depending on the location of the pair of ribs 452. For example, one pair of ribs 452 may extend longitudinally away from bottom deck 164*e* and from an upper wall portion 94*a* of wall portion 94, connecting to a bolt boss 44*e* and extending to an upper interior portion 82 of bolt boss 44*e*. In another example, one pair of ribs 452 may extend longitudinally away from bottom deck 164*e* and from an upper wall portion 95*b* of wall portion 95, connecting to bolt boss 44*e* and extending to upper interior portion 82 of a bolt boss 44*e*. In an exemplary embodiment, rib 452 extends to a location on bolt boss 44*e* that is at least 50% of the distance from bottom deck 164*e* to top surface 91. Preferably, rib 452 extends to a location on bolt boss 44*e* that is at least 75% of the distance from bottom deck 164*e* to top surface 91. Each pair of ribs 452 forms a "V" shape when viewed from a direction that is generally perpendicular to the plane of bottom deck 164*e*. Each one of the pair of ribs 452 lies on either side of a plane 96 that extends perpendicularly to and through bottom deck 164*e*, through the center of a component or central bore 38*e*, and through the center of a bolt boss 44*e*. A plane 97 extending perpendicularly to bottom deck 164*e* through the center of two valve bosses 48*e* that does not intersect central bore 38*e* will extend through one rib 452 of two different rib pairs. The angle of the "V" may be within the range 20 degrees to 60 degrees, but is more preferably within the range 30 degrees to 50 degrees, and most preferably in the range 35 degrees to 45 degrees.

When ribs 452 intersect upper wall portion 94*a* of wall portion 94 of intake passages 28*e* and upper wall portion 95*b* of wall portion 95 of exhaust passages 32*e*, ribs 452 are blended or radiused into wall portions 94*a* of wall exhaust passages 32*e*. Ribs 452 may extend into intake passages 28*e* and exhaust passages 32*e* to increase the rigidity of cylinder head 120*e*. However, ribs 452 should not interfere with the function of intake passages 28*e* and exhaust passages 32*e*. The improvement in PCP from ribs 452 is comparable to the PCP improvement from ribs 52. As with the previous embodiments, ribs 452 may be used in conjunction with the previously described embodiments to improve the PCP of cylinder head 120*e*.

Figure 14:
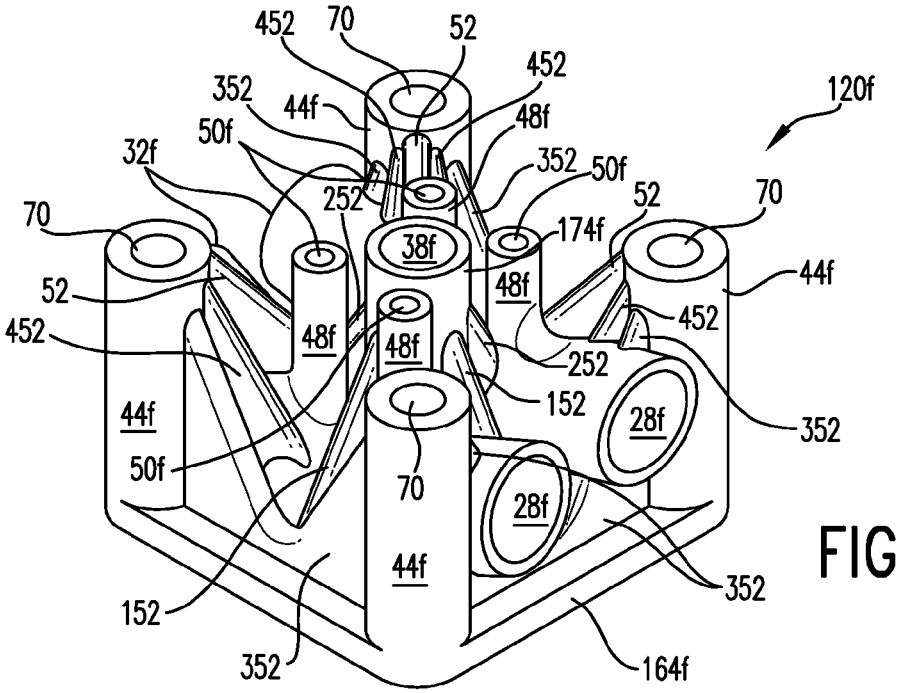
FIG. 14 is a perspective view of a cylinder head in accordance with a sixth exemplary embodiment of the present disclosure.
Figure 15:
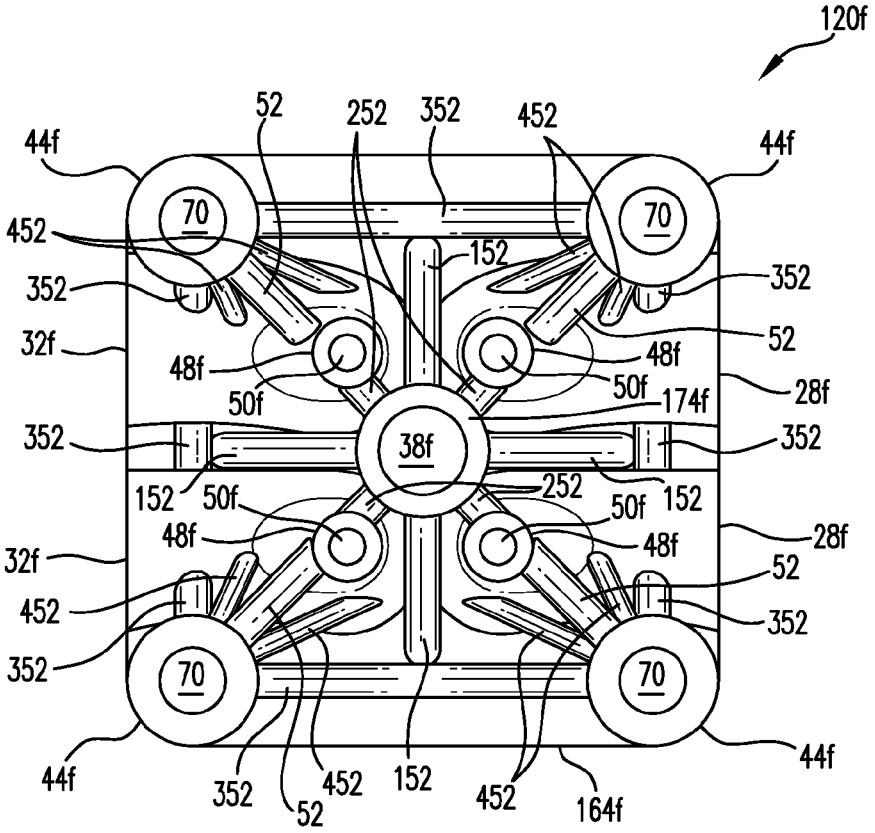
FIG. 15 is a plan view of the cylinder head of FIG. 14.

A sixth exemplary embodiment cylinder head of the present disclosure, indicated generally at 120*f*, is shown in FIGS. 14 and 15. Features having the same number as the previous embodiments or features having the same number as the previous embodiments and an appended letter, e.g., 44*a*, 44*b*, function similarly to the previous embodiments and are described in this embodiment only to the extent needed for clarity.

Cylinder head 120*f* features ribs from all the previously described embodiments, and the numbering of the ribs from the previously described embodiments is retained for simplicity and clarity, though use of all the ribs from the previous embodiment may entail minor modifications of the ribs of the previous embodiments to enable some ribs to be placed side-by-side. Use of all the exemplary embodiments provides the greatest possible PCP. However, use of all ribs may provide excessive restriction of the upper coolant gallery and the lower coolant gallery, which should be considered regardless which combination of previously described embodiments may be used.

While various embodiments of the disclosure have been shown and described, it is understood that these embodiments are not limited thereto. The embodiments may be changed, modified and further applied by those skilled in the art. Therefore, these embodiments are not limited to the detail shown and described previously, but also include all such changes and modifications.

We Claim:

1. A cylinder head for an internal combustion engine, the cylinder head comprising:

a bottom deck;

a component bore having an component bore wall extending longitudinally from the bottom deck;

a bolt boss extending longitudinally from the bottom deck and positioned at a first radial distance from the component bore;

a valve boss positioned a second radial distance from the component bore, the second radial distance being less than the first radial distance;

an intake passage wall;

an exhaust passage wall; and a first rib connected to one of the intake passage wall and the exhaust passage wall, the first rib extending longitudinally upward from the one of the intake passage wall and the exhaust passage wall and connected to the component bore wall.

2. The cylinder head of claim 1, wherein the first rib is also connected to the valve boss.

3. The cylinder head of claim 2, further comprising a second rib connected to the other of the intake passage wall and the exhaust passage wall, the second rib extending longitudinally upward from the other of the intake passage wall and the exhaust passage wall and connected to the component bore wall.

4. The cylinder head of claim 3, further comprising a second valve boss, wherein the second rib is also connected to the second valve boss.

5. The cylinder head of claim 3, further comprising a third rib connected to and extending longitudinally upward from the bottom deck and connected to the component bore wall.

6. The cylinder head of claim 5, further comprising a fourth rib connected to and extending longitudinally upward from one of the intake passage wall, the exhaust passage wall, and bottom deck, the fourth rib including a first rib end connected the bolt boss, wherein the fourth rib is free from contact with the component bore wall.

7. The cylinder head of claim 6, further comprising a second bolt boss, wherein the fourth rib is connected to and extends longitudinally upward from the bottom deck, and wherein the fourth rib includes a second rib end connected to the second bolt boss.

8. The cylinder head of claim 7, wherein the fourth rib extends longitudinally upward to a lesser extent intermediate the bolt boss and the second bolt boss than at the first rib end and the second rib end.

9. The cylinder head of claim 8, wherein the third rib has a "V" shape when viewed perpendicularly to the third rib, with the bottom of the "V" positioned closed to the bottom deck than the top of the "V".

10. The cylinder head of claim 3, further comprising a third rib connected to and extending longitudinally upward from one of the intake passage wall, the exhaust passage wall, and bottom deck, the third rib including a first rib end connected the bolt boss, wherein the third rib is free from contact with the component bore wall.

11. The cylinder head of claim 10, further comprising a second bolt boss, wherein the third rib is connected to and extends longitudinally upward from the bottom deck, and wherein the third rib includes a second rib end connected to the second bolt boss.

12. The cylinder head of claim 11, wherein the third rib extends longitudinally upward to a lesser extent intermediate the bolt boss and the second bolt boss than at the first rib end and the second rib end.

13. The cylinder head of claim 12, wherein the third rib has a "V" shape when viewed perpendicularly to the third rib, with the bottom of the "V" positioned closed to the bottom deck than the top of the "V".

14. The cylinder head of claim 1, further comprising a second rib connected to and extending longitudinally upward from one of the intake passage wall and the exhaust passage wall, wherein the second rib is free from contact with the component bore wall.

15. The cylinder head of claim 14, wherein the second rib is connected to the bolt boss.

16. The cylinder head of claim 15, further comprising a third rib connected to and extending longitudinally upward from one of the bottom deck, the third rib including a first rib end connected the bolt boss, wherein the third rib is free from contact with the component bore wall.

17. The cylinder head of claim 16, further comprising a second bolt boss, wherein the third rib includes a second rib end connected to the second bolt boss.

18. The cylinder head of claim 17, wherein the third rib extends longitudinally upward to a lesser extent intermediate the bolt boss and the second bolt boss than at the first rib end and the second rib end.

19. The cylinder head of claim 18, wherein the third rib has a "V" shape when viewed perpendicularly to the third rib, with the bottom of the "V" positioned closed to the bottom deck than the top of the "V".

* * * * *